United States Patent [19]

Tonel et al.

[11] Patent Number: 5,054,215

[45] Date of Patent: Oct. 8, 1991

[54] ADJUSTMENT DEVICE PARTICULARLY FOR SKI BOOTS

[75] Inventors: Valerio Tonel, Barbisano; Mario Mattiuzzo; Giancarlo Foscaro, both of Treviso; Stéfano Soligo, Montebelluna, all of Italy

[73] Assignee: Nordica S.P.A., Montebelluna, Italy

[21] Appl. No.: 224,024

[22] Filed: Jul. 25, 1988

[30] Foreign Application Priority Data

Aug. 6, 1987 [IT] Italy ..... 82582 A/87
Dec. 14, 1987 [IT] Italy ..... 82612 A/87

[51] Int. Cl.[5] ..... A43B 5/04
[52] U.S. Cl. ..... 36/170; 36/117
[58] Field of Search ..... 36/117–121; 403/61

[56] References Cited

U.S. PATENT DOCUMENTS

| | | | |
|---|---|---|---|
| 3,729,842 | 5/1973 | Stelzer | 36/120 |
| 4,455,768 | 6/1984 | Salomon | 36/121 |
| 4,615,128 | 10/1986 | Borsoi | 36/120 |
| 4,693,020 | 9/1987 | Salas et al. | 36/117 |
| 4,756,099 | 7/1988 | Walkhoff | 36/120 |

FOREIGN PATENT DOCUMENTS

| | | | |
|---|---|---|---|
| 217423 | 4/1987 | European Pat. Off. | 36/117 |
| 229638 | 7/1987 | European Pat. Off. | 36/117 |
| 241840 | 10/1987 | European Pat. Off. | 36/117 |
| 2807371 | 8/1979 | Fed. Rep. of Germany | 36/117 |
| 3504961 | 5/1986 | Fed. Rep. of Germany | 36/117 |

*Primary Examiner*—Paul T. Sewell
*Assistant Examiner*—Andrew D. Meyers
*Attorney, Agent, or Firm*—Guido Modiano; Albert Josif

[57] ABSTRACT

Device for ski boots comprising a front quarter and a rear quarter associated with a shell and/or an upper quarter embracing at least one portion of the leg of a skier and supported at the upper end of said front and/or rear quarter(s). The device has a slider which is movable transversely to said upper quarter and/or front quarter and/or rear quarter and/or shell, and interacts selectively with at least two separate abutments provided on said upper quarter and/or front quarter and/or rear quarter and/or shell.

33 Claims, 10 Drawing Sheets

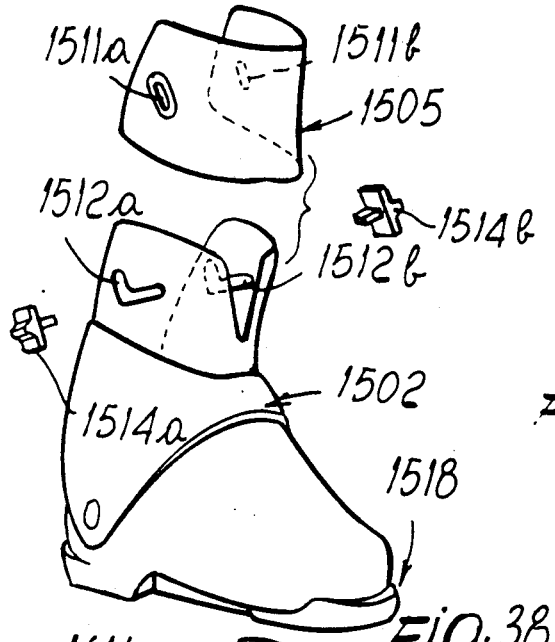
Fig. 38
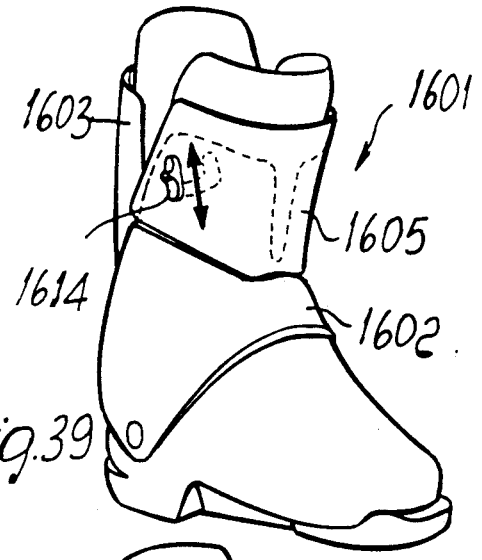
Fig. 39
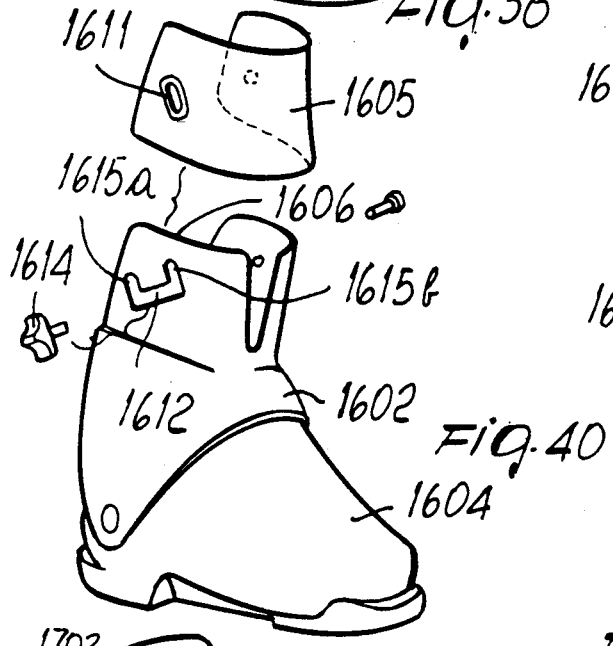
Fig. 40
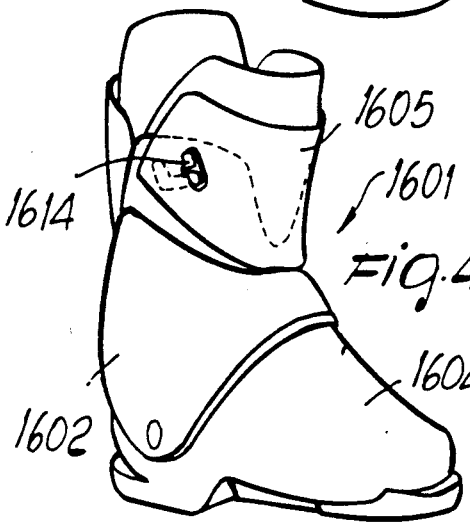
Fig. 41
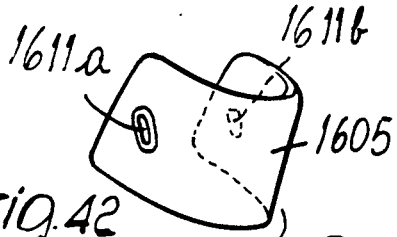
Fig. 42
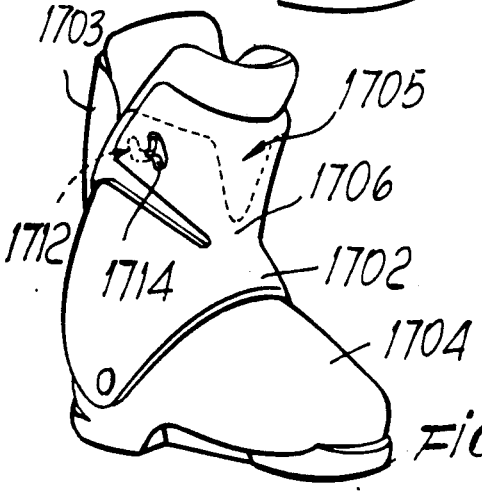
Fig. 43
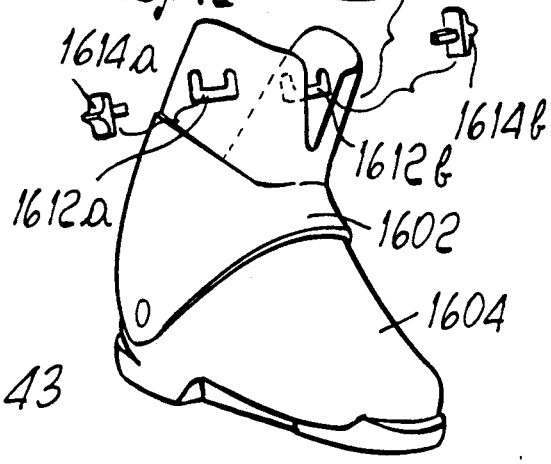

ADJUSTMENT DEVICE PARTICULARLY FOR SKI BOOTS

BACKGROUND OF THE INVENTION

The present invention relates to an adjustment device particularly for adjusting the flexing stroke or the inclination of ski boots.

Various devices are currently known which allow to adjust the technical characteristics of a ski boot such as the front or rear support degree, the extent of the flexing stroke or the longitudinal inclination of the quarter with respect to the shell.

U.S. Pat. No. 3,729,842 discloses a ski boot wherein the adjustment of the longitudinal inclination between the quarter and the shell of a front-entry boot is provided by means of two separate plates, one coupled to the quarter and the other to the shell, having a region of superimposition at which an eccentric is associated.

This known device has, however, some disadvantages, among which there is a condition of unstable equilibrium of the position of the eccentric while skiing.

This may cause the sudden disengagement of the eccentric from its selected position, the adjustment of the inclination being thus lost.

German patent DE 2807371 discloses the use of at least one eccentric having its rotation point located at the shell or at the quarter of a ski boot wherein the quarter is pivotally fixed to the shell.

Also in this case, however, the use of the eccentric, which adjusts the inclination of the quarter with respect to the shell, leads to a condition of unstable equilibrium, while from an ergonomic viewpoint to rotate the eccentric the skier has to exert a fatiguing torsional movement with the arm.

As a partial solution to these disadvantages, this same Assignee filed a U.S. patent application Ser. No. 07/000785 on Jan. 5, 1987, disclosing a support adjuster for ski boot quarters the peculiarity whereof resides in the fact that it comprises a shaped body which embraces at least one portion of the leg of the skier and is supported at the upper end of the quarter of a ski boot, and in that it has removable locking means for the location of said shaped body with respect to said quarter.

Though this adjuster is undoubtedly effective, it is however complicated from a manufacturing point of view and is therefore little economical.

SUMMARY OF THE INVENTION

The aim of the present invention is to eliminate the disadvantages described above in known ski boots by providing a device which allows, depending on its arrangement, to obtain the adjustment of the support or of the flexing stroke or of the inclination in ski boots.

Within the scope of the above described aim, an important object is to provide a structurally simple device, therefore easily applicable to a ski boot so as to be economically very competitive.

Still another important object is to provide a device which allows the skier to select stable positions while skiing.

Yet another object is to provide a device which does not subject the skier's arm to any fatiguing torsion while operating it.

Not least object is to provide a device having an easy and swift operation.

This aim and these objects, as well as others which will become apparent hereinafter, are achieved by an adjustment device, particularly for ski boots comprising at least one first and one second mutually movable elements, characterized in that it comprises at least one slider slideable on one of said elements of said boot and interacting with at least one abutment element fixed on the other of said elements of said boot.

BRIEF DESCRIPTION OF THE DRAWINGS

Further characteristics and advantages of the invention will become apparent from the detailed description of some preferred but not exclusive embodiments, illustrated only by way of non-limitative example in the accompanying drawings, wherein:

FIGS. 35, 36, 37 and 38 illustrate another embodiment of the invention according to views respectively similar to those of FIGS. 23, 21, 22 and 24;

FIGS. 39, 40, 41 and 42 illustrate still another embodiment in views similar to those of FIGS. 35, 36, 37 and 38;

FIG. 43 illustrates a boot according to a further aspect of the invention;

DESCRIPTION OF THE PREFERRED EMBODIMENTS

Figure 1:
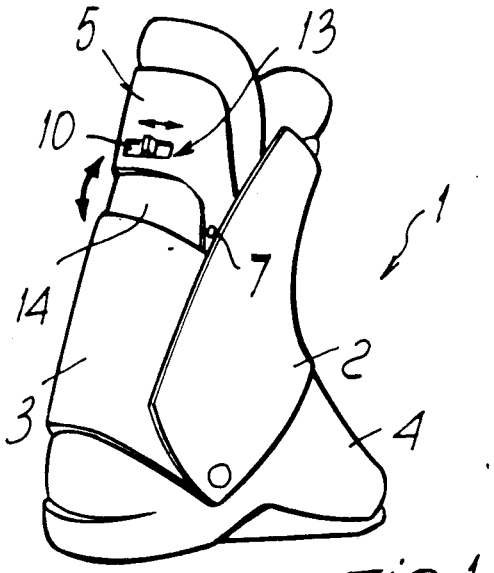
FIG. 1 is a view of the device applied at an upper quarter supported by the rear quarter of a rear-entry ski boot.
Figure 2:
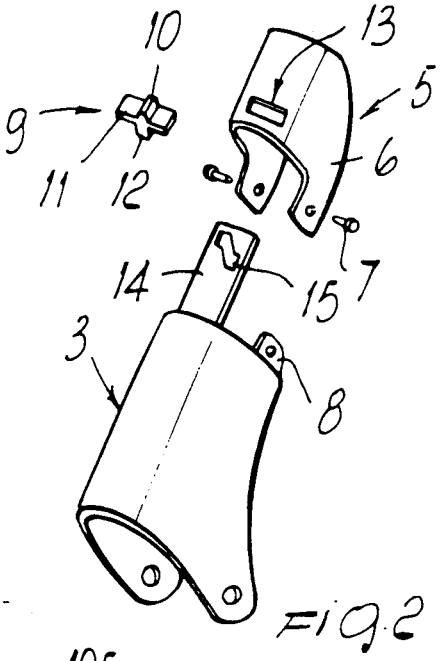
FIG. 2 is a schematic view of the device applied to the rear quarter.

With reference to the above described figures, the device is applicable at ski boots 1 comprising a front quarter 2 and a rear quarter 3, associated with a shell 4, and an upper quarter 5 defining component parts movable with respect to each other.

The upper quarter 5 embraces at least one portion of the leg of the skier and has a pair of lateral wings 6 rotatably supported, by means of adapted pivots or rivets 7, at shoulders 8 protruding upwardly and laterally to the rear quarter 3.

The device comprises a substantially T-shaped slider 9 having a protrusion 10 projecting transversely to the wings 11 on the opposite side with respect to its stem 12.

The slider 9 is slideably associated at guide means in the shape of a slot 13 provided transversely to the upper quarter 5; the protrusion 10, arranged along an axis which is longitudinal to the rear quarter 3, protrudes alone from said slot.

A preferably elastically deformable tab 14 protrudes at the upper end of said rear quarter; the upper end of the tab 14 interacts with the inner surface of the upper quarter 5, and in particular tab 14 of the rear quarter 3 and upper quarter 5 define partially overlapping surface portions in overlapping relationship to each other; a guiding seat 15, for the stem 12 of the slider 9, being provided at the region of the slot 13. In practice the slot 13 defines a through-going recess having a delimiting edge, the guiding seat 15 defines gliding abutment surface means having two rest formations for the stem 12 defining a first body portion of the slider 9. Furthermore the slider 9 defines a second body portion arranged at least in part in the slot 13 and in sliding engagement with the delimiting edge thereof. In particular, the second body portion of the slider 9 comprises the wings 11 and the protrusion 10, the latter defining an actuation formation.

Said seat 15 is in the shape of an inverted S, two separate abutments for the stem 12 being therefore defined at its ends.

The use of the device is as follows: once the ski boot is on, the skier, by gripping the projection 10, imparts a leftward or rightward movement to the slider 9 which is followed by a translatory motion of the stem 12 at the seat 15 which forces the upper quarter 5 to vary its inclination with respect to the rear quarter 3. In practice, the two rest formations of the guiding seat 15 determine a first relative posture of the upper quarter 5 with respect to the rear quarter 3 when the first body portion or stem 12 of the slider reaches a first of the two rest formations and a second relative posture of said quarters when the first body portion reaches a second of the two rest formations.

An adjustment of the rear support is thus achieved by means of a swift and easy operation.

The device is furthermore structurally very simple, it allows the selection of stable positions while skiing and is economically very competitive.

Naturally the seat 15 may be provided directly at the rear quarter 3 by making the upper quarter 5 partially embrace the latter.

The configuration of the seat 15 may also be the most appropriate, it being possible to provide even more than two separate abutments for the stem 12 of the slider 9.

Figure 3:
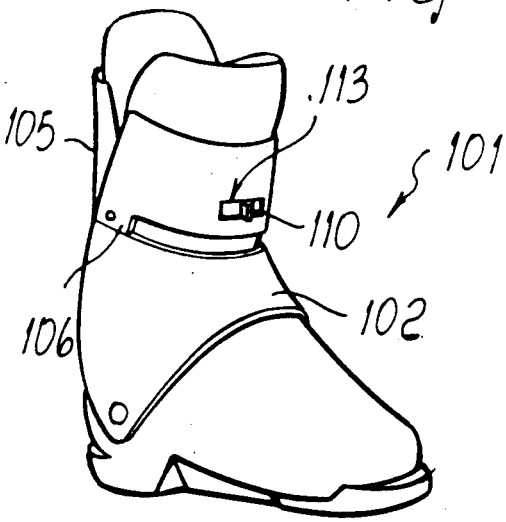
FIG. 3 is a front angle view of the device applied at an upper quarter supported by the front quarter.
Figure 4:
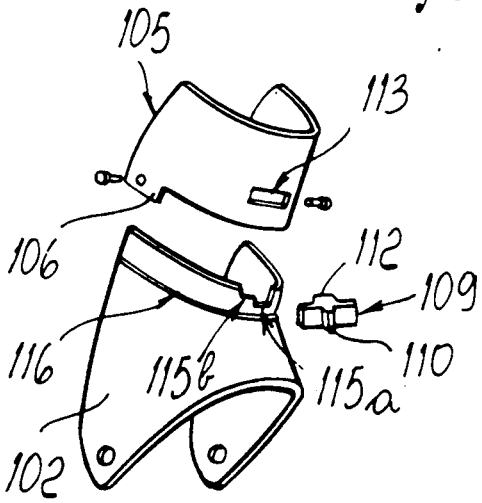
FIG. 4 is an exploded view of the arrangement of device illustrated in FIG. 3.

FIGS. 3 and 4 illustrate a first variated aspect of a ski boot 101 having an upper quarter 105 provided with a pair of lateral wings 106 laterally supported at the upper end of the front quarter 102, preferably in a pivotable manner.

A slot 113 is provided transversely to the upper quarter 105 at the tibial resting region and the slider 109 has a jut 110 protruding from the slot 113.

The stem 112 of said slider interacts with at least two separate abutments **115*a* and 115*b* provided in a recess-like formation of the front quarter 102 by conveniently shaping the upper edge 116 of the front quarter 102 which is arranged facing the inner surface of the upper quarter 105 at the region of the slot 113**.

An adjustment of the forward support is thus obtainable, since by moving the slider 109 transversely within the slot 113 its stem 112 is located at the two separate abutments **115*a* and 115*b*** which naturally have different depths.

Naturally a similar configuration may be devised having the slot provided at the front quarter and the abutments provided at the upper quarter.

Figure 5:
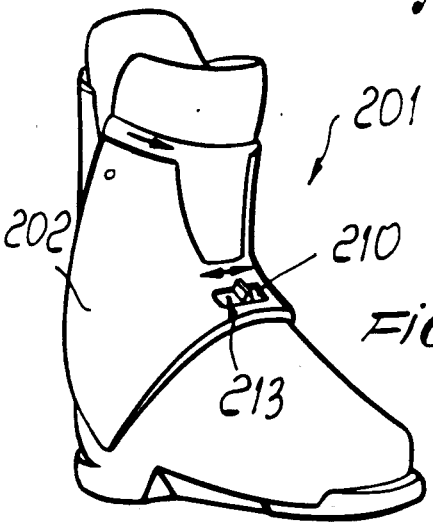
FIG. 5 is a front angle view of the application of the device at the front quarter of the rear-entry ski boot.
Figure 6:
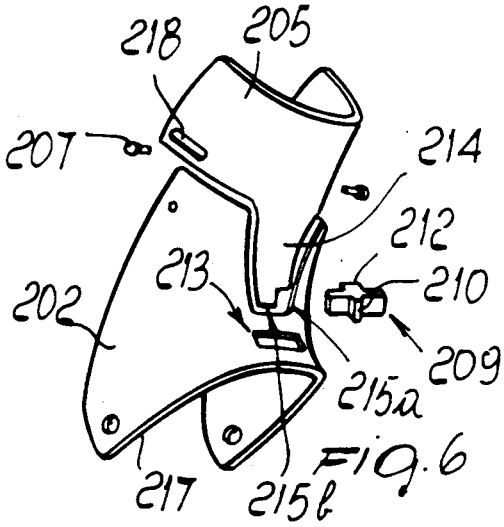
FIG. 6 is a view, similar to FIGS. 2 and 4, of the device of FIG. 5.

FIGS. 5 and 6 illustrate such an embodiment, wherein on the front quarter 202 of the ski boot 201 a transverse through-going recess defining a slot 213 is provided, proximate to its front perimetral edge 217 and in the region overlying the foot instep.

The slider 209 is slideably accommodatable within said slot, and it is positioned with respect to said slot by gripping the jut 210.

The stem 212 of the slider 209 interacts with at least two separate abutments **215*a*, 215*b* provided at the ends of a flap 214 protruding longitudinally to the upper quarter 205 which is rotatably and/or slideably associated with the front quarter 202**.

The upper quarter 205 in fact has adapted guide slots 218 for its sliding with respect to the pivots 207 which connect the upper quarter to the front quarter.

In this case, too, an adjustment of the forward support and therefore of the stroke of the tibial support during flexing is achieved.

Figure 7:
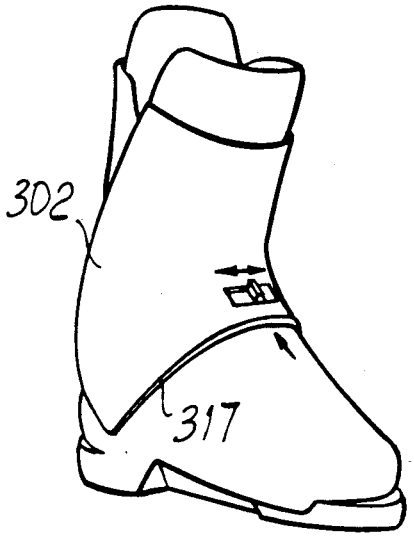
FIG. 7 is a view of a further embodiment wherein the device is again applied at the front quarter of a rear-entry ski boot.
Figure 8:
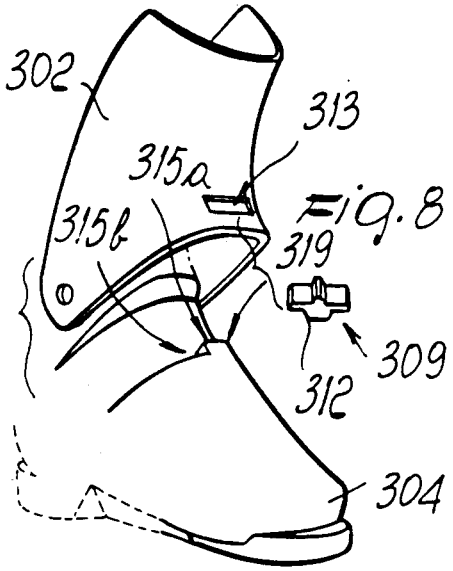
FIG. 8 is a schematic view of the arrangement of the device of FIG. 7.

FIGS. 7 and 8 illustrate a third embodiment wherein the slot 313 (defining the through-going recess) is provided directly at the front quarter 302 proximate to its front perimetral edge 317 and in the region approximately overlying the foot instep.

Slider 309 is T-shaped and has wings which are slideably associable within the slot; the actuation formation of the slider is in the shape of a protrusion protruding through the slot 313 in slidable relationship with the delimiting edge thereof and the stem or rib 312 of the slider, extending transverse to the wings of the same slider, interacts with adapted separate abutments 315*a* and 315*b*, defining rest formations forming a step therebetween and formed at a raised wall portion 319 provided on the shell 304 in the region approximately underlying the slot 313, said raised wall portions extending transverse to the general extension of the shell. As visible, the abutments 315*a* and 315*b* are formed at a mutual distance in the mutual movement direction of the quarter 302 and 304 so as to define therebetween a step.

It is thus possible to obtain an adjustment of the flexing stroke while skiing.

Figure 9:
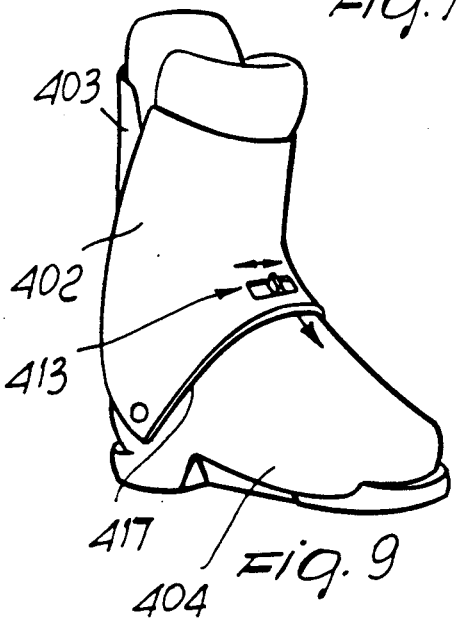
FIGS. 9 and 10 illustrate, in views respectively similar to those of FIGS. 7 and 8, a further embodiment of the device applied at the front quarter.
Figure 10:
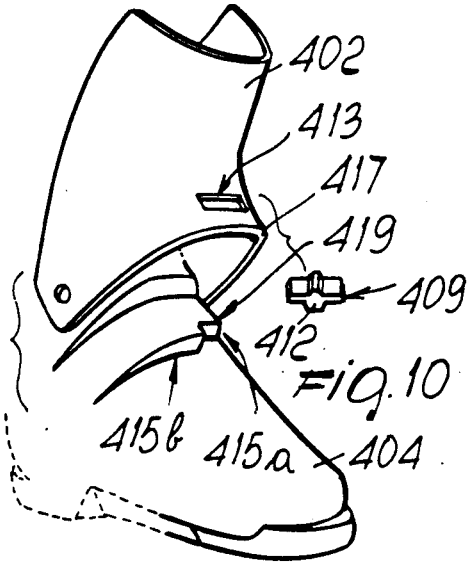

FIGS. 9 and 10 illustrate a fourth embodiment, wherein the slot 413 is provided at the front quarter 402 proximate to its front perimetral edge 417 and approximately at the foot instep region. The raised wall portion 419, provided at the shell 404, has at least two separate abutments 415*a*, 415*b* interacting with the stem 412 of the slider 409 upon a rotation of the front quarter 402 in the direction of the rear quarter 403.

It is thus possible to obtain an adjustment of the longitudinal inclination of the front quarter with respect to the shell.

Figure 11:
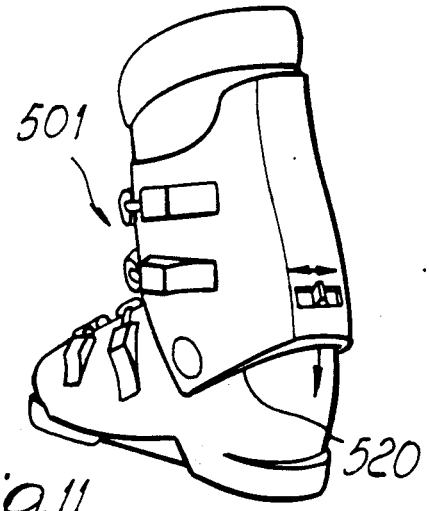
FIGS. 11 and 12 illustrate, in rear angle views, the device applied to the quarter of a front-entry boot.
Figure 12:
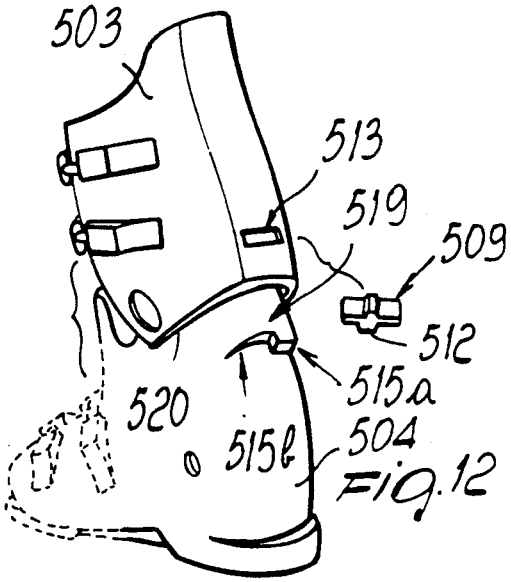

FIGS. 11 and 12 illustrate a fifth embodiment, wherein the slider 509 is slideably associated at a slot 513, provided transversely to the quarter 503 of a front-entry boot and proximate to its lower perimetral edge 520.

The stem 512 of the slider 509 interacts with at least two separate abutments 515*a*, 515*b* , defined at a raised wall portion 519 which protrudes from the shell 504 at the slot 513.

Said abutments have their surface of interaction with the stem of the slider directed towards the heel of the boot.

It is thus possible to obtain the adjustment of the flexing stroke of the quarter of the boot.

An equivalent embodiment of this case, is the accommodation of the slider at the shell, with the related abutments provided at the quarter.

Figure 13:
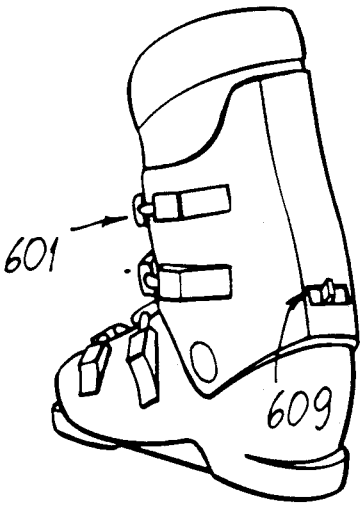
FIGS. 13 and 14 illustrate, in views similar to those of FIGS. 11 and 12, a different embodiment of the device.
Figure 14:
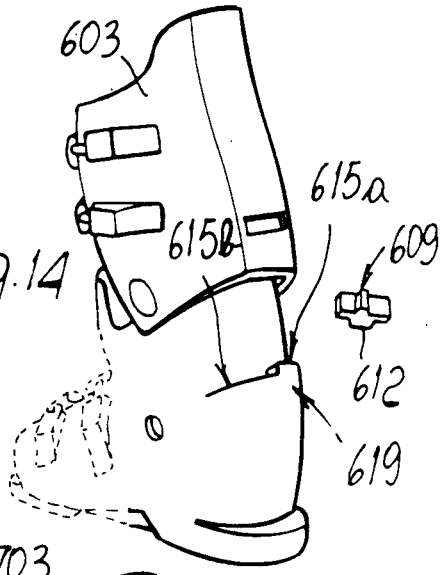

FIGS. 13 and 14 illustrate a sixth embodiment, wherein the raised wall portion 619 is provided so that the surfaces of the abutments 615*a* and 615*b*, interacting with the stem 612 of the slider 609, are directed towards the upper end of the quarter 603 of the front-entry ski boot 601.

In this case, too, it is thus possible to obtain the adjustment of the longitudinal inclination of the quarter 603 with respect to the shell 604.

Figure 15:
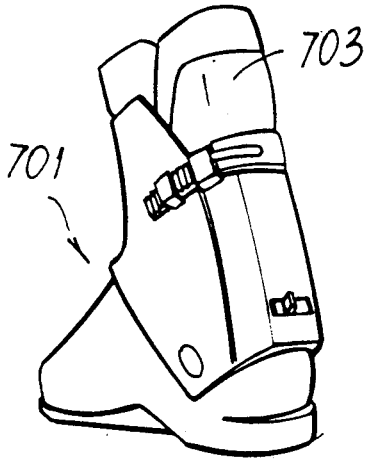
FIGS. 15 and 16 illustrate, in views similar to the preceding ones 13 and 14, the arrangement of the device at the rear quarter of a rear-entry ski boot.
Figure 16:
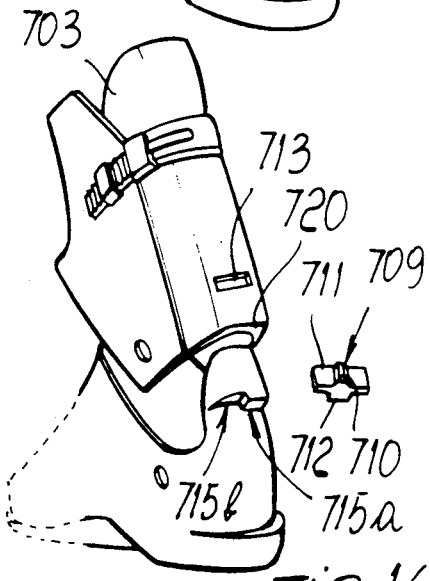

FIGS. 15 and 16 illustrate a seventh embodiment wherein the slider 709 has its stem 712 interacting with the surfaces of at least two separate abutments 715*a* and 715*b* directed towards the heel of the rear-entry boot 701.

In this case the slot 713 is provided at the rear quarter 703 proximate to the lower perimetral edge 720 thereof in a region overlying the two separate abutments.

In this case, too, the slider has a jut 710 projecting from the wings 711 for the grip of the skier.

Figure 17:
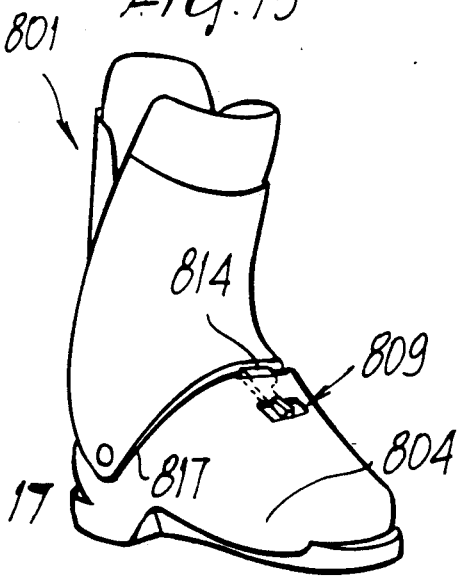
FIGS. 17 and 18 illustrate, in views similar to FIGS. 9 and 10, a further embodiment of the device.
Figure 18:
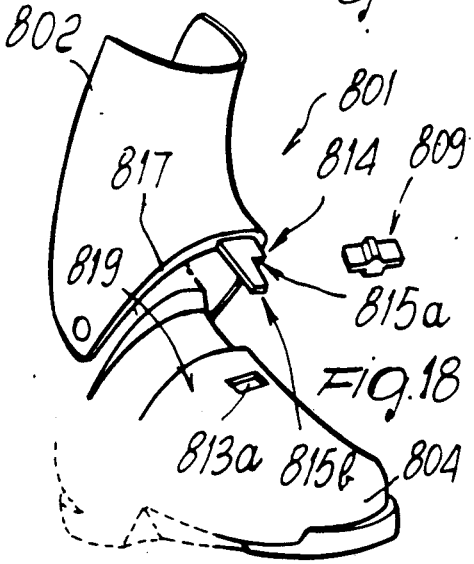

FIGS. 17 and 18 illustrate a ski boot 801 having a front quarter 802 with a front perimetral edge 817. Longitudinally to said boot, a tab or flap 814 protrudes beyond the edge 817 and has at least two separate abutments 815*a* and 815*b* defining the rest formations at its free end.

A first transverse slot 813*a*, in which a slider 809 is slideable accommodatable, is provided on the shell 804 at a raised portion 819 forming a raised wall portion defining the general extension of said shell and a transverse wall portion extending transverse thereto and facing the front perimetral edge of the front quarter. Also in this embodiment the slider member is T-shaped having a first body portion formed by a rib or stem interacting with the rest formations 815*a*, 815*b*, a second body portion comprising two wings and an actuation formation in the shape of a protrusion protruding through the first slot 813*a*.

Figure 19:
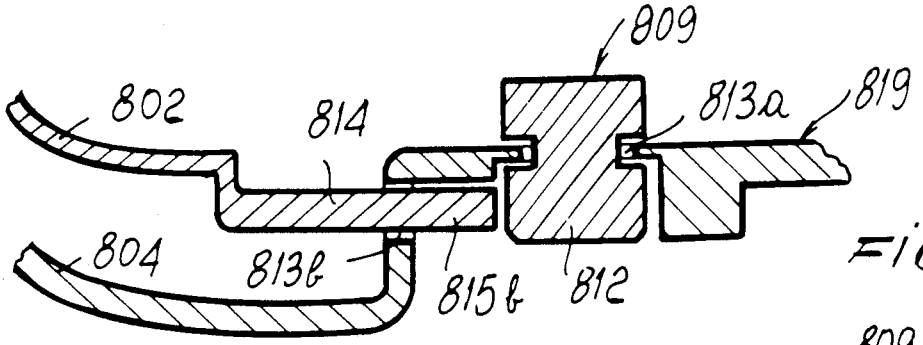
FIGS. 19 and 20 are sectional views, respectively taken along longitudinal and transverse sectional planes of the boot, of the device of the preceding figures.

At the raised portion 819, the free end of the tab, or flap, 814 passes freely within a second slot 813*b*, provided in said transverse wall portion along an axis which is longitudinal to the boot (see FIG. 19).

Figure 20:
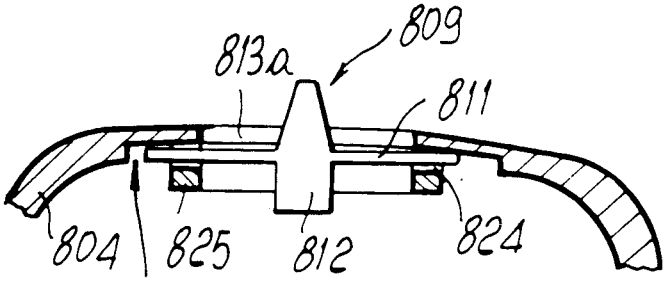
Figure 21:
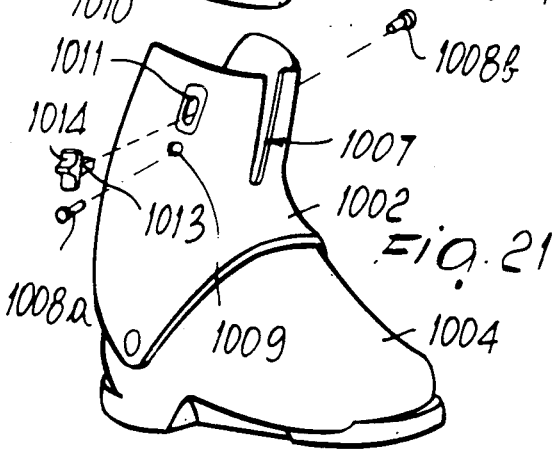
FIG. 21 is an exploded view of a boot according to a further embodiment.

The abutments 815*a* and 815*b* can thus interact with the stem 812 of the slider 809. The wings 811 of the slider are slideably accommodated within two guides 824 and 825 provided on the inner surface 826 of the shell 804 proximate to the longitudinal ends of the first slot 813*a* (see FIG. 20).

FIGS. 21–24 illustrate an adjustment device according to a further embodiment of the invention and applicable at rear-entry ski boots 1001, constituted by a front quarter 1002 and by a rear quarter 1003 associated with a shell 1004 and comprising an upper quarter 1005, or at monolithic ski boots wherein the front quarter 1002 is provided integrally with the shell 1004.

The upper quarter 1005 embraces a portion of the front part of the leg of the skier and is locatable internally to the front quarter 1002 proximate to the upper end 1006 thereof.

The quarter 1002 is frontally provided with a vertical slot 1007, approximately at its middle longitudinal axis, to allow the elastic deformation of said front quarter 1002 upon a forward flexing of the skier's leg.

Said upper quarter 1005 is associated at least with the sides of the front quarter 1002, e.g. by means of adapted small pins 1008*a* and 1008*b* which pass within adapted holes 1009 provided laterally to said front quarter 1002 or to said upper quarter.

At least a guide, constituted for example by a slot 1010 arranged so as to allow the sliding of the upper quarter with respect to the front quarter 1002, is conveniently provided at said holes 1009 laterally to said upper quarter 1005.

At least at one side of said front quarter there is a further guide in form of a through-going recess 1011 arranged along an axis approximately parallel to the longitudinal axis of said front quarter 1002.

At said recess 1011 said upper quarter 1005 has a substantially L-shaped seat 1012 defining the gliding abutment surface means. One wing of the seat 1012 is directed towards the rear quarter 1003 and the other wing towards the upper end 1006 of said upper quarter 1005.

The stem 1013 of a substantially T-shaped slider 1014, actuatable by the skier, is arrangeable within said recess 1011 and said seat 1012.

The use of the device is as follows: to adjust the flexibility it is sufficient to impart a translatory motion to the slider 1014 within the recess 1011.

Figure 22:
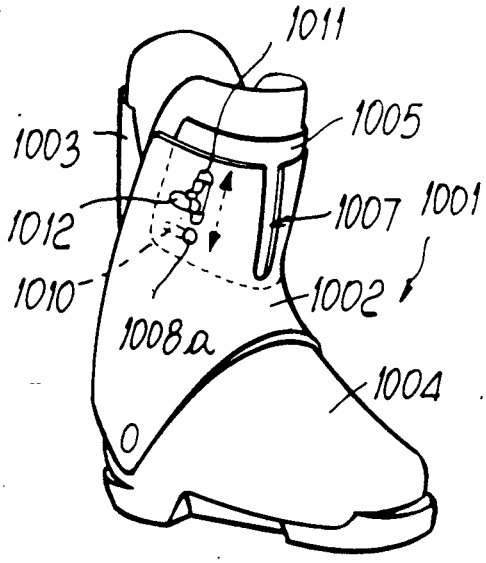
FIGS. 22 and 23 illustrate the different positions of the slider of the boot of FIG. 21.
Figure 23:
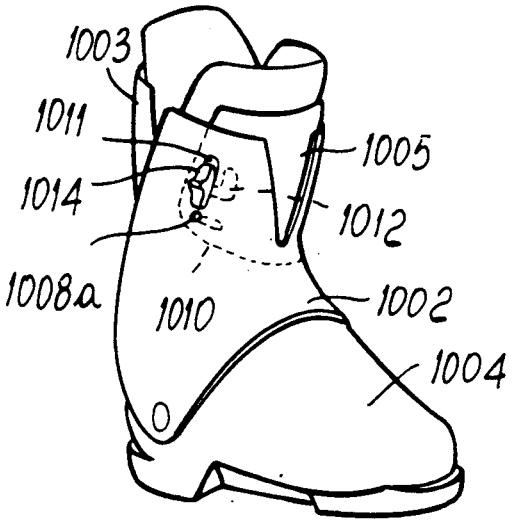

In the condition illustrated in FIG. 22, i.e. with the slider 1014 having its stem at the crossing point of the wings of the seat 1012, upon a forward flexing said stem 1013 can slide at the wing of the seat 1012 which is directed towards the rear quarter 1003 (see FIG. 23).

Vice versa by arranging the slider at the opposite end of the recess 1011 said sliding is prevented, thus making the boot rigid.

It is naturally possible to provide a seat 1012 having a plurality of wings directed towards the rear quarter 1003 and having different depths so as to thus obtain a further diversification of the degree of adjustment of the flexibility.

Figure 24:
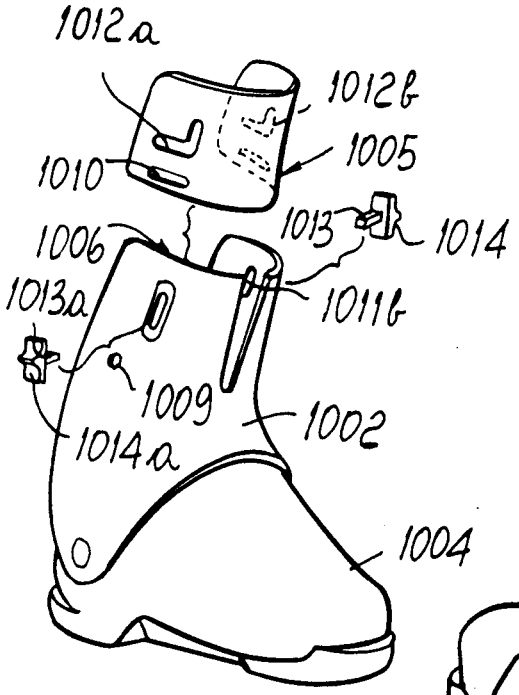
FIG. 24 illustrates the use of two separate sliders.

Naturally, as illustrated in FIG. 24, on the front quarter 1002 it is possible to provide a pair of recesses 1011*a* and 1011*b*, identical to one another and specular with respect to the longitudinal middle plane of the boot. The recesses 1011*a* and 1011*b* act as seats for the stems 1013*a* and 1013*b* of a pair of sliders 1014*a* and 1014*b*, said stems being slideable within a pair of seats 1012*a* and 1012*b* provided on said upper quarter 1005.

Figure 25:
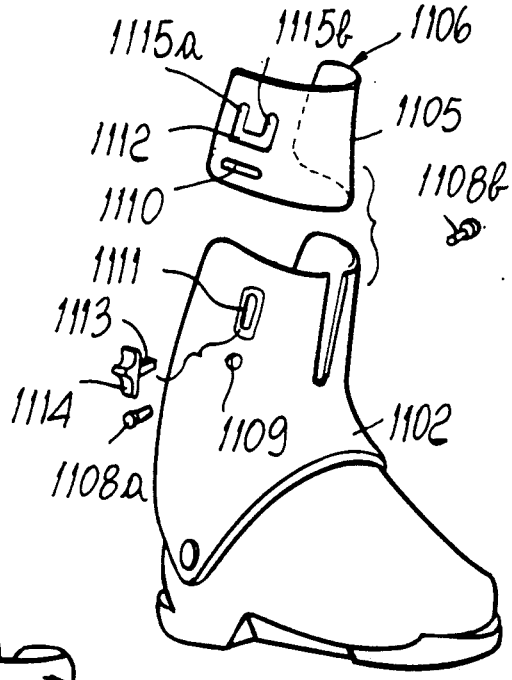
FIGS. 25, 26, 27 and 28 illustrate, in views respectively similar to those of FIGS. 21, 22, 23 and 24, yet another embodiment of the device.
Figure 27:
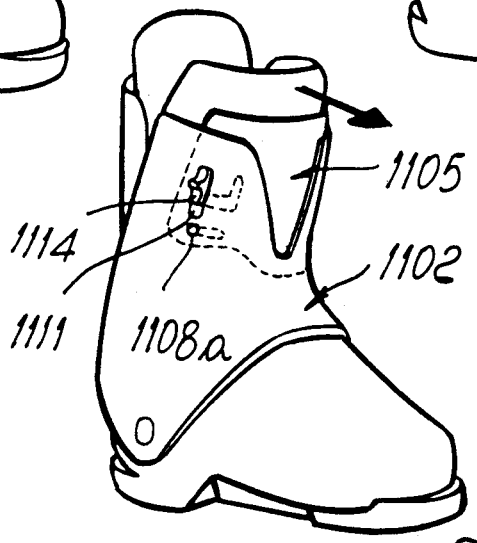
Figure 26:
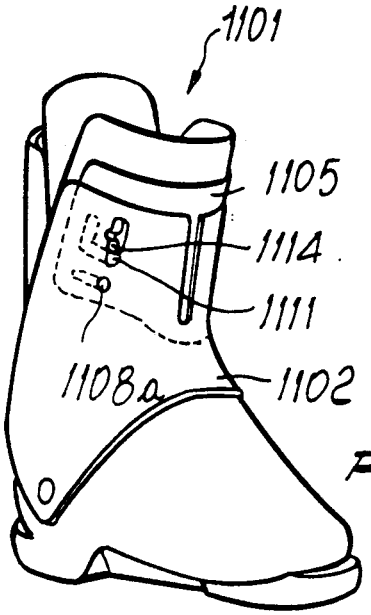

FIGS. 25, 26 and 27 illustrate a boot 1101 according to another embodiment of the invention, the front quarter 1102 whereof again has a lateral guide formed by a through-going recess 1111, arranged approximately longitudinally to said quarter 1102, and an upper quarter 1105.

The upper quarter 1105 is arranged internally to the front quarter 1102 and is associated therewith by means of small pivots 1108*a* and 1108*b* passing through adapted holes 1109 and slideable at a guide 1110, which is constituted for example by a slot provided at the same side of the recess 1111.

The seat 1112 is provided on said upper quarter 1105 at the recess 1111 and, in the illustrated embodiment, has an essentially U-shaped configuration; the wings 1115*a* and 1115*b* whereof are directed towards the upper end 1106 or the lower end of said upper quarter 1105.

Therefore, according to the position in which the stem 1113 of the slider 1114 is located, it is possible to achieve an adjustment not only of the degree of flexibility but also of the inclination of the upper quarter 1105.

In fact, depending on whether the stem 1113 is positioned at the ends of the wings 1115*a* or 1115*b*, a given inclination is imparted to the upper quarter.

Figure 28:
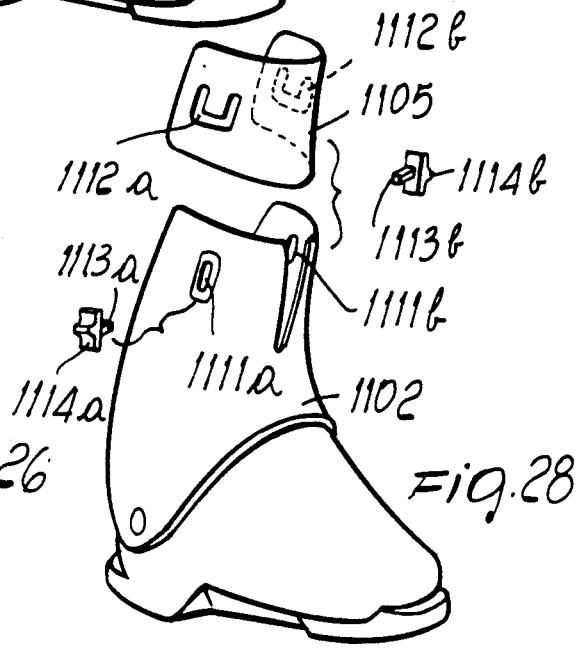

If a single slider is used, a tibial support adjustment is mainly achieved, while, as illustrated in FIG. 28, the actual inclination adjustment may be obtained by using a pair of sliders 1114*a* and 1114*b*, the stems 1113*a*, 1113*b* whereof slide within a pair of recesses 1111*a*, 1111*b* while a pair of seats 1112*a*, 1112*b* is provided on the upper quarter 1105.

Figure 29:
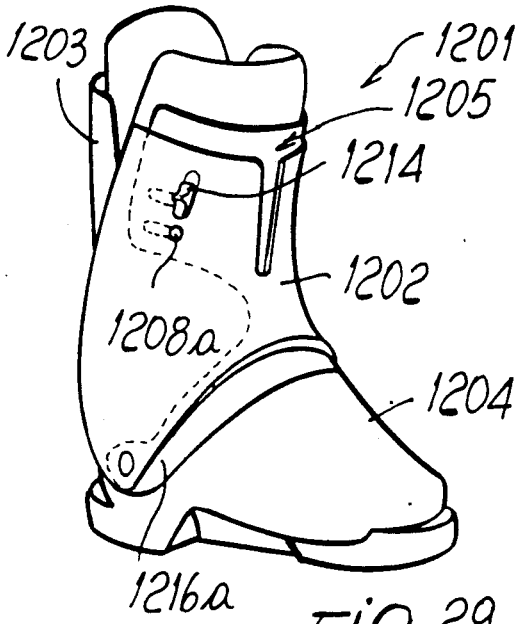
FIG. 29 is a lateral angle view of a ski boot having an adjustment device according to another aspect of the invention.
Figure 30:
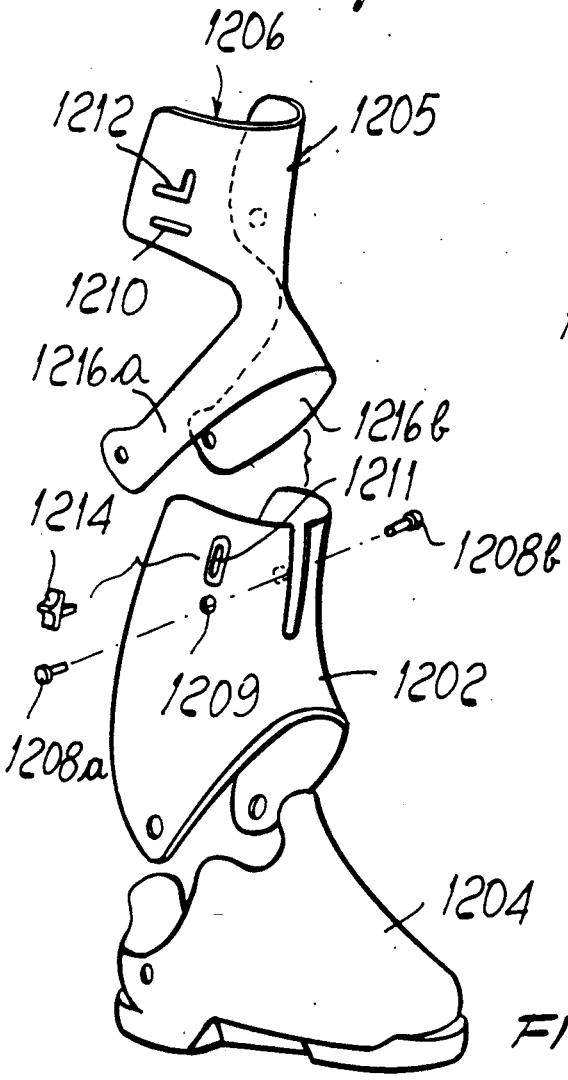
FIG. 30 is an exploded view of the boot of FIG. 29.

FIGS. 29 and 30 illustrate another embodiment, wherein the boot 1201 has again a front quarter 1202 and a rear quarter 1203 pivoted to a shell 1204; the upper quarter 1205 is downwardly provided with a pair of tabs 1216*a* and 1216*b*, laterally and externally embracing the shell 1204, being possibly but not necessarily associable therewith together with the front quarter.

Laterally to the front quarter 1202 there is again a guide formed by a through-going recess 1211 arranged along an axis approximately parallel to the longitudinal one of said front quarter, holes 1209 being furthermore provided on the latter for small pins 1208*a* and 1208*b*, the first one whereof is slideable at an adapted guide in form of a slot 1210 provided on said upper quarter 1205 at the side adjacent to the side of the front quarter which has the recess 1211.

On the upper quarter there is an L-shaped seat 1212 having wings directed towards the rear quarter 1203 and towards the upper end 1206 of said upper quarter.

As in the embodiment illustrated in FIGS. 21–24, the slider 1214 allows to adjust the flexibility with the advantage that the configuration of the upper quarter allows a certain elastic return of the front quarter during extension.

Naturally the seat 1212 may also have a U-shaped configuration, as illustrated in FIGS. 25, 26 and 28.

Figure 31:
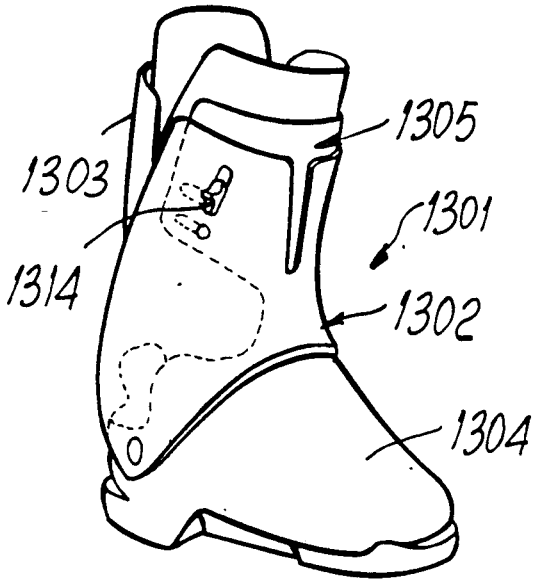
FIGS. 31 and 32 illustrate, in views respectively similar to FIGS. 29 and 30, a further embodiment of the device.
Figure 32:
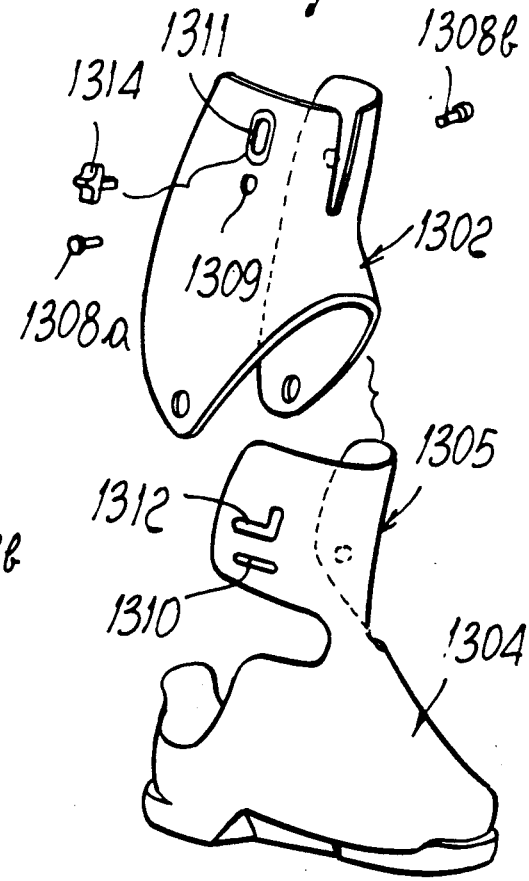

In the embodiment illustrated in FIGS. 31 and 32 a boot 1301 is composed of a front quarter 1302 and of a rear quarter 1303 pivoted to a shell 1304 with which the upper quarter 1305 is integrally associated.

On at least one side, the upper quarter 1305 also has a guide in form of a slot 1310 within which there may slide a first pin 1308*a* which passes, analogously to a second pin 1308*b*, at adapted holes 1309 provided laterally to the front quarter 1302 and on the upper quarter on the opposite side to the slot 1310.

A seat 1312, again having an L-shaped configuration, is furthermore provided, the through-going recess 1311 within which the slider 1314 may slide being provided at said seat on the front quarter 1302.

This particular solution offers the advantage, with respect to the preceding ones, of eliminating a component, besides providing an elastic return of the front quarter 1302 during extension.

The seat 1312 may also be U-shaped.

Figure 33:
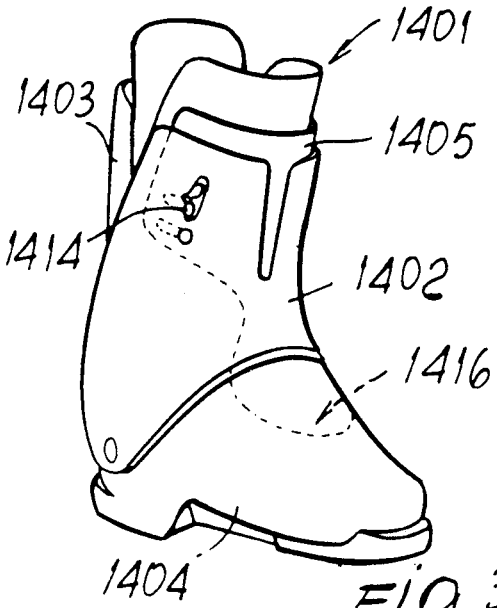
FIGS. 33 and 34 illustrate, in views respectively similar to those of FIGS. 29 and 30, yet another embodiment of the device.
Figure 34:
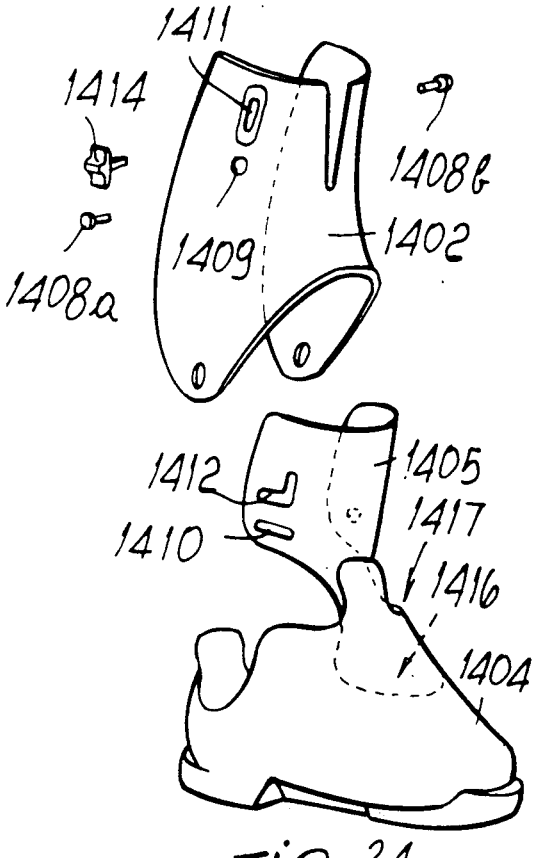
Figure 35:
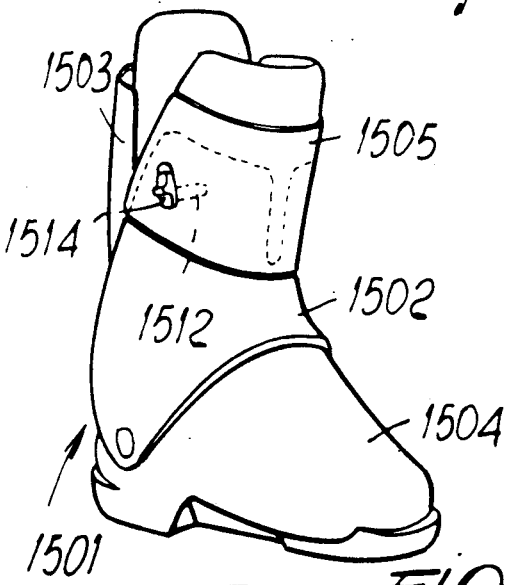
Figure 36:
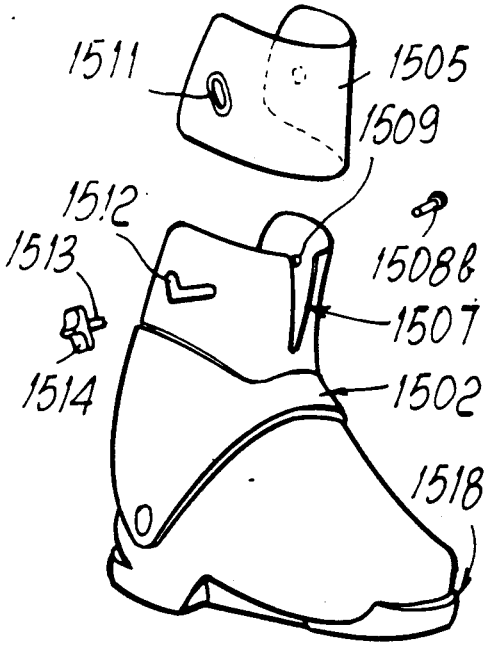

FIGS. 33 and 34 illustrate a boot 1401 again constituted by a front quarter 1402 and by a rear quarter 1403 pivoted to a shell 1404.

In this particular embodiment the upper quarter 1405 has a single tab 1416 downwardly protruding therefrom and acting as presser at the region 1417 of the skier's foot instep.

On at least one side of the front quarter 1402 there is again a through-going recess 1411 arranged approximately parallel to the longitudinal axis of said rear quarter and at the underlying quarter there is an L-shaped seat 1412.

The upper quarter is associated with the front quarter by means of adapted pivots 1408*a*1408*b* passing through adapted holes 1409 provided on said front quarter and through slot 1410 and through hole 1410*a*, respectively, the latter being formed in said upper quarter on the opposite side with respect to the slot 1410. The slot 1410 is provided on the upper quarter at the same side of the front quarter in which the recess 1411 is provided.

Differently from the previously illustrated solutions, this last allows to achieve a significant increase of the degree of securing of the instep of the foot during flexing.

The seat 1412 may also have a U-shaped configuration.

FIGS. 35, 36, 37 and 38 illustrate another embodiment of the device applied to a ski boot 1501 composed of a front quarter 1502 and of a rear quarter 1503 pivoted to a shell 1504.

In this embodiment, the upper quarter 1505 is arranged externally to the front quarter 1502, at least at one side of the upper quarter there being provided a through-going recess in form of a guide slot 1511 arranged inclined with respect to the longitudinal middle axis of the front quarter.

The seat 1512 defining gliding abutment surface means for the stem 1513 of the slider 1514 is instead provided on at least one side of the front quarter 1502 at the recess 1511 provided on the upper quarter, and at least a guide slot for pins according to what is illustrated in the previsous embodiment may also be provided.

Said seat 1512 has a first portion parallel to said recess 1511 and the other one perpendicular thereto directed towards the formation 1507 provided on said front quarter 1502 thereof.

On the opposite side to the seat 1512 the upper quarter 1505 and the front quarter 1502 have a hole 1509 for a small pivot 1508*b*.

Similarly to the embodiment illustrated in FIGS. 21–24, a pair of recess 1511*a*, 1511*b* and, on the front quarter, a pair of seats 1512*a*, 1512*b*, for the sliding of the stems of a pair of sliders 1514*a*, 1514*b*, may be provided (FIG. 38).

FIGS. 39, 40, 41 and 42 illustrate a further embodiment of the device applied to a ski boot 1601 composed of a front quarter 1602 and of a rear quarter 1603 pivoted to a shell 1604.

Similarly to the preceding embodiment, the upper quarter 1605 is external to the front quarter 1602, on the latter there being provided at least one U-shaped seat 1612, at the first guide 1611 of the upper quarter. The seat 1612 has wings 1615*a* and 1615*b* arranged inclined approximately in the direction of the upper end 1606 or of the lower one of the front quarter, and at least one guide defining a through-going recess 1610 for pins, according to what is illustrated in the embodiment illustrated in FIGS. 21–24, may also be provided.

The use is similar to what has been previously illustrated and described, the positioning of the slider 1614 allowing to achieve an adjustment both of the flexibility and of the inclination of the upper quarter.

In this case, too, it is naturally possible to provide, laterally to the front quarter 1602, a pair of seats 1612*a* and 1612*b*, together with a pair of recesses 1611*a* and 1611*b*, for the sliding of a pair of sliders 1614*a* and 1614*b* (FIG. 42).

FIG. 43 illustrates a ski boot wherein the upper quarter 1705 is obtained by monolithic molding integrally with the front quarter 1702 and is joined to said quarter in the central region 1706 which acts as hinge for the rotation of the upper quarter 1705.

Figure 37:
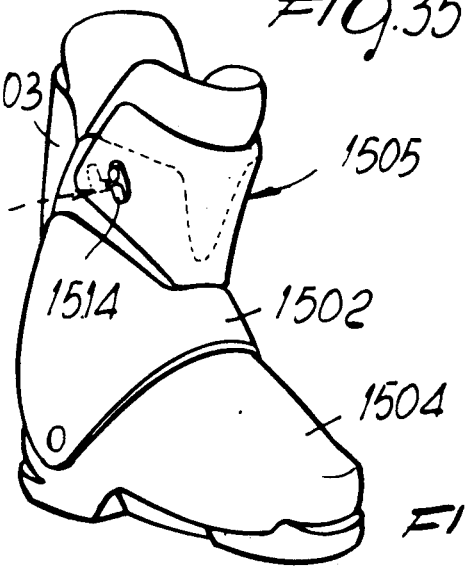

The boot furthermore has the seat 1712 for the slider 1714 similarly to what is described for the boot of FIG. 37.

Figure 44:
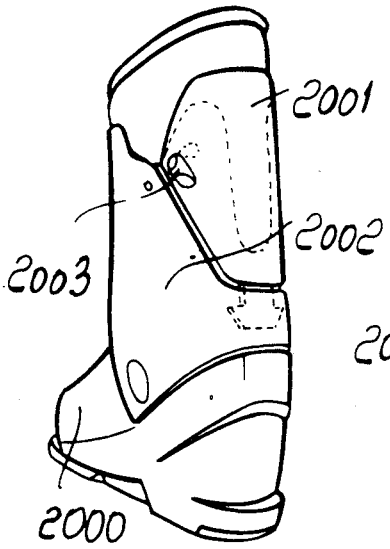
FIGS. 44, 45 illustrate a ski boot, respectively in a perspective view and in a partial exploded view, according to another aspect of the invention.
Figure 46:
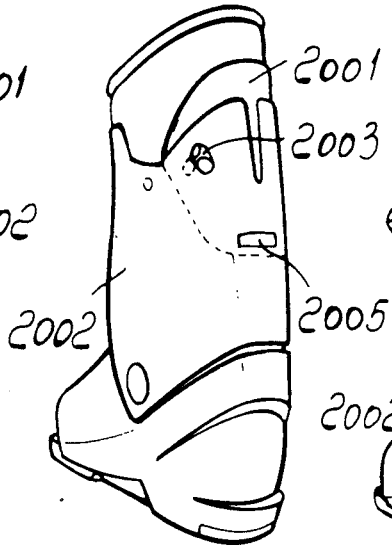
FIG. 46 is a view of the ski boot of FIG. 44, slightly modified.
Figure 45:
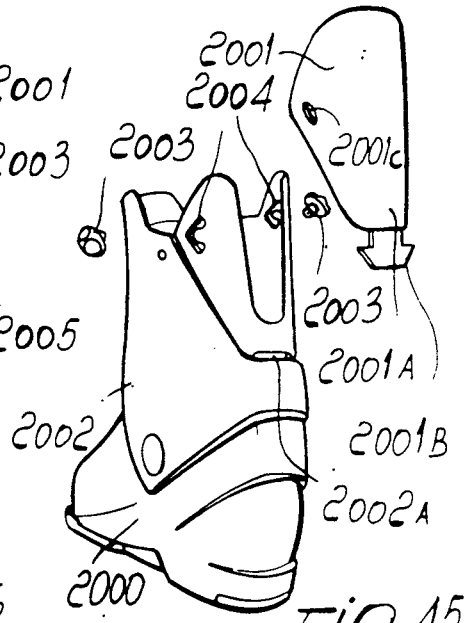

The boot of FIGS. 44, 45, 46 has its upper quarter 2001 pivoted to the quarter 2002, at its lower part 2001A, for example by means of elastic connection means in form of the elastically deformable tab 2001B inserted snap-together in the slot 2002A of the quarter (as for swingable connecting the upper quarter 2001 to the quarter 2002 illustrated in FIG. 45), or by means of a plate 2005 (as illustrated in FIG. 46).

Laterally there is at least one slider 2003 adapted to vary the inclination of the upper quarter 2001 with respect to the quarter 2002 by means of the different arrangement of said slider on the gliding abutment surface means defining a guide seat 2004 provided in one side portion of the quarter 2002.

The upper quarter 2001 of FIGS. 44, 45 is external to the quarter 2002, while FIG. 46 illustrates an internal upper quarter; the illustrated boot is of the front-entry type, but it may also be of the rear-entry type.

In particular, as visible, the quarter 2002 is hinged to the ski boot shell 2000 so as to define overlapping surface portions, while the through-going recess is in the form of a slot 2001C provided in the upper quarter 2001 in one side portion thereof and extending in a direction inclined with respect to the longitudinal middle axis of the quarter 2002. Furthermore the guide seat 2004 has a first portion extending parallel to the slot 2001C and a second portion extending perpendicular to the first portion thereof while the slider 2003 has a pin shaped body portion for abutting against the guide seat 2004.

Figure 47:
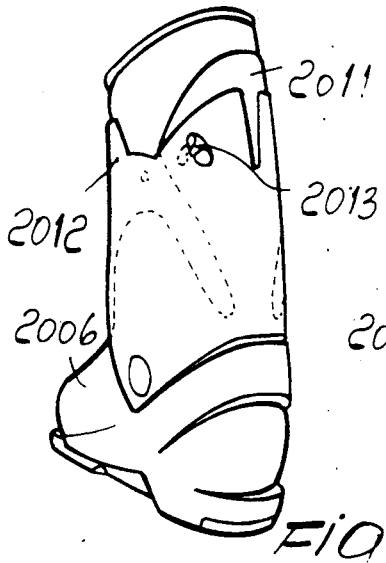
FIGS. 47, 48 are rear views of a boot according to a further aspect of the invention.
Figure 48:
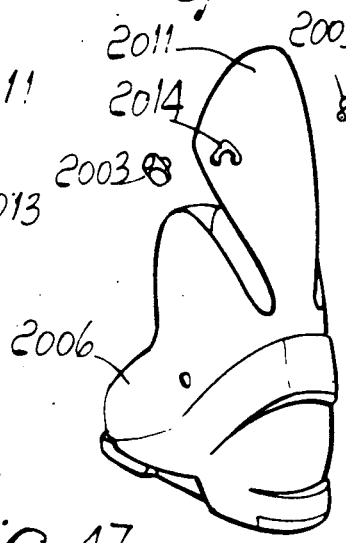
Figure 48:
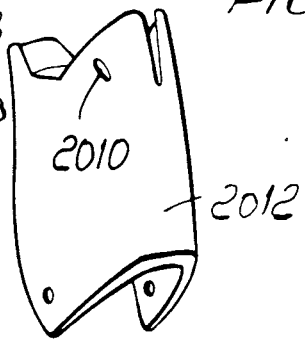

FIGS. 47 and 48 illustrate a boot wherein the upper quarter 2011 is integral with the shell 2006 and is arranged inside the quarter 2012; in this case, too, there is a slider 2003 adapted to vary the inclination of the upper quarter 2011 by means of its different positioning on the seat 2014. In particular, as visible, the rear quarter 2012 defines guide means in form of a through-going recess or slot 2010 which extends in a direction inclined to the longitudinal middle axis of the rear quarter, and the seat 2014 is in the shape of an inverted V having a portion thereof which is substantially parallel to the slot 2010.

FIGS. 49–54 illustrate different further embodiments of the device, substantially similar to what is illustrated in the previously described FIGS. 1–16.

In this case (FIGS. 49, 49A and 50, 50A) the slider 3001 is connected to a small band 3002 so as to be arrangeable on one side of the boot.

The band 3002 has in fact a tooth 3003 interacting with the abutment element 3004, while the slider 3001 is actuatable from outside of the boot by virtue of the presence of the slot 3005 on the quarter 3006.

Figure 49:
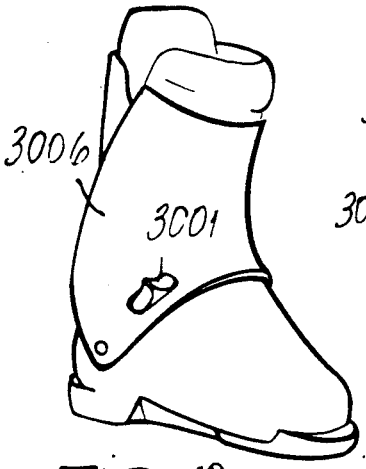
FIGS. 49, 49A, illustrate, respectively in perspective and exploded views a further embodiment of the ski boot.
Figure 49A:
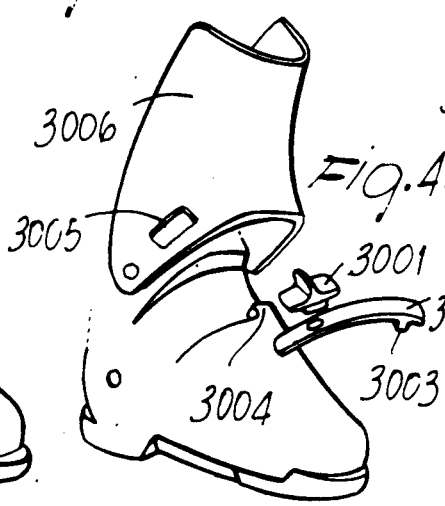
Figure 50:
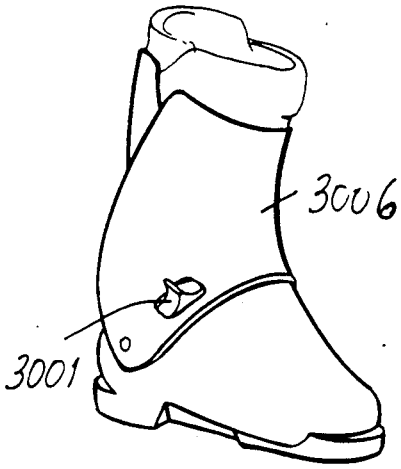
FIGS. 50, 50A are views similar to the preceding ones showing a ski boot according to a further aspect of the invention.
Figure 50A:
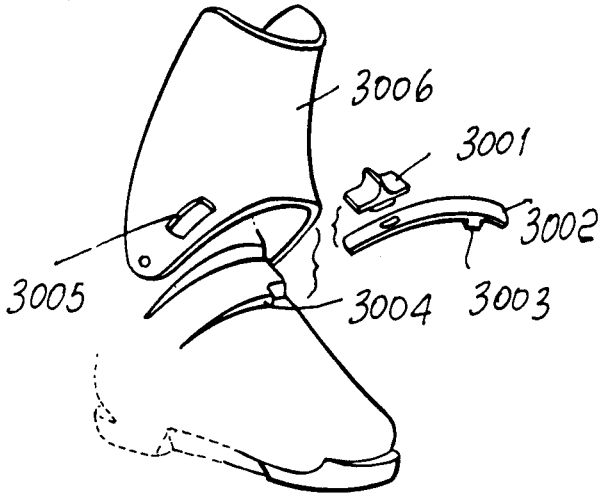

The device illustrated in FIG. 49, 49A adjusts the flexing stroke of the quarter, while the device of FIG. 50, 50A adjusts its inclination.

Figure 51:
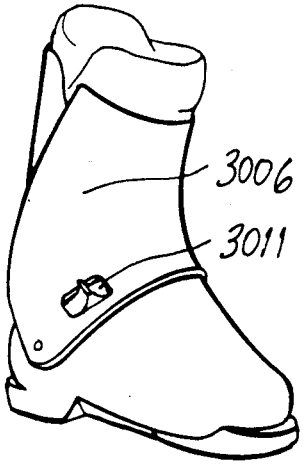
FIGS. 51, 51A show still a further embodiment of the invention.
Figure 51A:
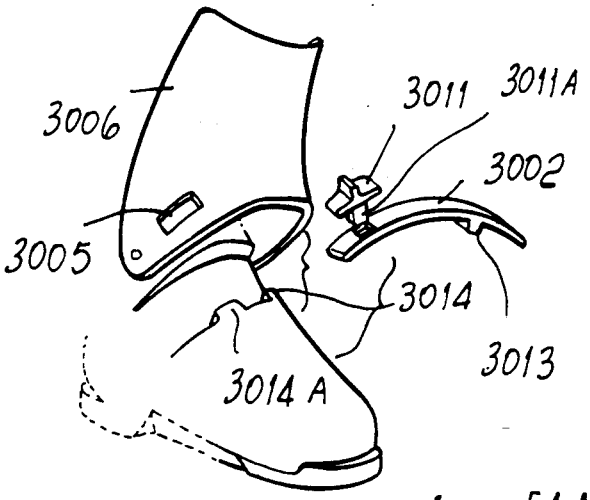
Figure 52:
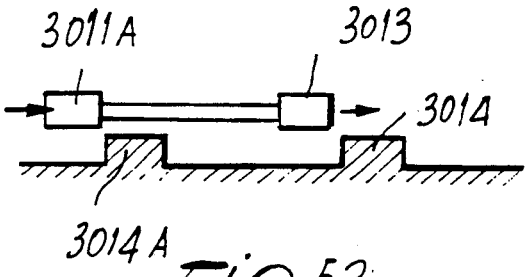
FIG. 52 is a transverse sectional view of the adjustment means of the boot of FIGS. 51, 51A.

FIGS. 51, 51A and 52 illustrate a bilateral-action device wherein the slider 3011 has a tooth 3011A interacting with the abutment 3014A of the shell.

The adjustment action occurs between the teeth 3011A, 3013 and, respectively, the abutments 3014A and 3014.

Figure 53:
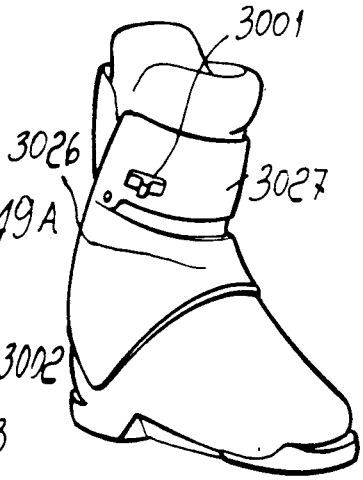
FIGS. 53, 54 illustrate a further embodiment of the boot according to the invention.
Figure 54:
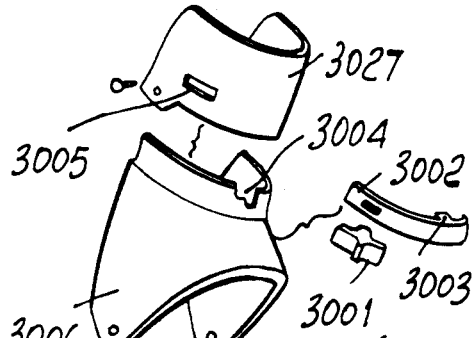

Finally, FIGS. 53 and 54 illustrate a device substantially similar to the one described in FIG. 49 but interacting between the upper quarter 3027 and the front quarter 3026.

It has thus been observed that the device according to the invention achieves the intended aim and objects, allowing the adjustment of the flexibility in a simple and rapid manner on the part of the skier, who has to act with minimum effort.

The materials, as well as the dimensions, may be any according to the requirements and to the state of the art.

We claim:

1. In a composite ski boot having at least two component parts movable with respect to each other and having at least partially overlapping surface portions in overlapping relationship to each other, an adjustment device for adjusting the relative position of said two component parts relative to each other, said device comprising means defining a through-going recess in one of said two overlapping surface portions, said recess having a a delimiting edge, gliding abutment surface means in the other of said two overlapping surface portions, said gliding abutment surface means facing said through-going recess, and a slider member having a first body portion facing said gliding abutment surface means for abutting thereagainst and having a second body portion arranged at least in part within said through-going recess and in sliding engagement with said delimiting edge thereof, said second body portion having an actuation formation accessible for actuation from the outside, said gliding abutment surface means having at least two rest formations for said first body portion, said two rest formations determining a first relative posture of one of said component parts with respect to the other of said two component parts when said first body portion reaches a first of said two rest formations and said two rest formations determining at least a second relative posture of said one of said component parts relative to said other of said two component parts when said first body portion reaches a second of said two rest formations.

2. An adjustment device according to claim 1, wherein one of said two component parts is an inclinable front quarter having a front perimetral edge and the other of said two component parts is a ski boot shell having an instep region facing said front perimetral edge, said through-going recess is a slot provided in said front quarter proximate said perimetral edge and in the region approximately overlying the foot instep region, said slider member is T-shaped, said first body portion whereof being in the form of a rib, said second body portion whereof being in the shape of wings extending transverse to said rib and slidable past said slot and said actuation formation being in the shape of a protrusion protruding through said slot and in slidable relationship with said delimiting edge thereof, said gliding abutment surface means being defined by raised wall portions of said shell extending transverse to the general extension of said shell and said rest formations defining a step therebetween.

3. An adjustment device according to claim 1, wherein one of said two component parts is a front quarter having one of said overlapping surface portions at the upper end portion thereof and the other of said component parts being an upper quarter externally surrounding said one of said overlapping surface portions of said front quarter, said through-going recess being in the form of a slot provided in said upper quarter in at least one side portion thereof and extending in a direction inclined with respect to the longitudinal middle axis of the front quarter, said gliding abutment surface means comprising a seat provided in at least one side portion of said one of said overlapping surface portions of said front quarter, said seat having a first portion extending parallel to said slot and a second portion extending perpendicular to said first portion thereof.

4. An adjustment device according to claim 1, wherein one of said two component parts is a quarter hinged on a ski boot shell and having one of said two overlapping surface portions and the other of said two component parts is an upper quarter having a lower portion including elastic connection means for swingably connecting said upper quarter to said quarter and wherein said through-going recess is in the form of a slot provided in said upper quarter in at least one side portion thereof and extending in a direction inclined with respect to the longitudinal middle axis of said quarter, said gliding abutment surface means comprising a seat provided in at least one side portion of said one of said overlapping surface portions of said quarter, said seat having a first portion extending parallel to said slot and a second portion extending perpendicular to said first portion thereof and wherein said slider has said first body portion thereof pin shaped.

5. In a composite ski boot having at least two component parts movable with respect to each other defining at least two overlapping surface portions in overlapping relationship to each other, an adjustment device for adjusting the relative position of said two component parts relative to each other, said device comprising guide means in one of said two overlapping surface portions, gliding abutment surface means in the other of said two overlapping surface portions, and a slider member having a first body portion facing said gliding abutment surface means, a second body portion engaging with said guide means and an actuation formation accessible for actuation from the outside, said gliding abutment surface means having at least two rest formations for said first body portion, said two rest formations determining a first relative posture of one of said component parts with respect to the other of said two component parts when said first body portion reaches a first of said two rest formations and at least a second relative posture of said one of said component parts relative to said other of said two component parts when said first body portion reaches a second of said two rest formations.

6. In a composite ski boot having at least two component parts movable with respect to each other and having surface portions in overlapping relationship to each other, an adjustment device for adjusting the relative position of said two component parts relative to each other, said device comprising guide means in one of said two overlapping surface portions, gliding abutment surface means in the other of said two overlapping surface portions, said gliding abutment surface means defining at least two rest formations, and a slider member having a first body portion for abutment engagement with said gliding abutment surface means, a second body portion sliding along said guide means and an actuation formation accessible for actuation from the outside, said slider member being movable with respect to said one of said two overlapping surface portions at least between a first position wherein said first body portion faces a first of said two rest formations and a second position wherein said first body portion faces a second of said two rest formations, with said first of said two rest formations determining a first relative posture of one of said component parts with respect to the other of said two component parts when said first body portions abuts against said first of said two rest formations and said second of said two rest formations determining at least a second relative posture of said one of said component parts relative to said other of said two component parts when said first body portion abuts against said second of said two rest formations.

7. An adjustment device according to claim 6, wherein said guide means extends in a transverse direction with respect to the relative movement direction of said component parts.

8. An adjustment device according to claim 6, wherein said two rest formations extend at a distance from each other in the relative movement direction of said two component parts.

9. An adjustment device according to claim 6, wherein one of said component parts is a front quarter having a front perimetral edge and the other of said two component parts is a ski boot shell having an instep region facing said front perimetral edge, with said guide means being provided in said front quarter proximate said perimetral edge and in the region approximately overlying said instep region, and said gliding abutment surface means being provided in said ski boot shell.

10. An adjustment device according to claim 6, wherein said guiding means is a slot, said first body portion of said slider member is a rib, said second body portion extends at least partially through said slot and said actuation formation is in the shape of a protrusion protruding through said slot.

11. An adjustment device according to claim 6, wherein said gliding abutment surface means comprises raised wall portions of said other of said two component parts, with said two rest formations extending adjacent to each other and forming therebetween a step.

12. An adjustment device according to claim 10, wherein said sliding member is T-shaped, said second body portion is in the shape of wings extending transverse to said rib and slidable past said slot.

13. An adjustment device according to claim 5, wherein one of said two component parts is a rear quarter and the other of said two component parts is an upper quarter rotatably supported above said rear quarter, said guide means being provided in said upper quarter and said gliding abutment surface means being provided in said rear quarter.

14. An adjustment device according to claim 13, wherein said rear quarter defines an upwardly protruding flap extending below said upper quarter and forming said gliding abutment surface means in the shape of a seat and wherein said guide means comprises a slot.

15. An adjustment device according to claim 5, wherein one of said two component parts is a front quarter and the other of said two component parts is an upper quarter rotatably supported above said front quarter, said guide means being provided in said upper quarter.

16. An adjustment device according to claim 5, wherein one of said two component parts is a ski boot shell and the other of said two component parts is a rear quarter pivoted to ski boot shell, said guide means being provided in said rear quarter.

17. An adjustment device according to claim 5, wherein said gliding abutment surface means comprise a substantially S-shaped seat defining, at end portions, thereof said rest formations for said first body portion of said slider member.

18. An adjustment device according to claim 5, wherein one of said two component parts is a front quarter having one of said overlapping surface portions at the upper end portion thereof and the other of said two component parts is an upper quarter externally surrounding said one of said overlapping surface portions of said front quarter, said gliding abutment surface means being defined by a shaped recess-like formation formed at said upper end portion of said front quarter.

19. An adjustment device according to claim 5, wherein one of said component parts is a front quarter and the other of said component parts is an upper quarter rotatably and slidably associated with said front quarter, said upper quarter defining a flap protruding longitudinally and having a shaped end extending under said front quarter and defining said rest formations.

20. An adjustment device according to claim 5, wherein one of said component parts is a ski boot shell and the other of said component parts is a front quarter pivoted to said ski boot shell, said front quarter defining a front perimetral edge and a flap protruding longitudinally to the front quarter from said front perimetral edge, said flap having a free end defining said rest formations, said boot shell having a raised portion forming a raised wall portion determining the general extension of said shell and a transverse wall portion extending transverse thereto and facing said front perimetral edge of said front quarter, said transverse wall portion defining a transverse slot having two longitudinal ends and allowing free sliding of said flap, said raised wall portion defining a further slot extending transverse to said flap and an inner surface defining two guides provided proximate to said longitudinal ends of said transverse slot, and wherein said slider member is T-shaped with said first body portion being a rib interacting with said rest formations of said flap, said second body portion comprising two wings slidably accommodated within said guides provided on the inner surface of said raised wall portion and said actuation formation being in the shape of a protrusion protruding through said further slot.

21. An adjustment device according to claim 5, wherein one of said two component parts is a front quarter defining said guide means and the other of said two component parts is an upper quarter embracing a portion of the skier's leg front part and defining said gliding abutment surface means, said front quarter having a longitudinal front slot, said upper quarter being arranged internally to said front quarter.

22. An adjustment device according to claim 21, wherein said upper quarter is pivoted to said front quarter, with said front quarter defining at least one through-going hole in at least one side portion thereof and said upper quarter defining at least one side aperture facing said through-going hole of said front quarter, at least one pivot being provided passing in said through-going hole and said side aperture.

23. An adjustment device according to claim 21, wherein said upper quarter is downwardly provided with a pair of flaps laterally and externally embracing a ski boot shell, said pair of flaps being pivoted to said ski boot shell.

24. An adjustment device according to claim 21, wherein said upper quarter is provided with a single flap downwardly protruding from a middle portion of said upper quarter, said flap extending internally to a ski boot shell down to the foot instep region and defining a presser for the skier's foot.

25. An adjustment device according to claim 21, wherein said upper quarter is integral with a ski boot shell.

26. An adjustment device according to claim 22, wherein said side aperture comprises a slot extending in a substantially parallel direction with respect to the relative movement direction of said upper and front quarters to allow sliding of the upper quarter with respect to said front quarter.

27. An adjustment device according to claim 21, wherein said guide means comprises a through-going elongated recess extending approximately parallel to the longitudinal axis of said front quarter at least at one side thereof.

28. An adjustment device according to claim 21, wherein said gliding abutment surface means comprises an essentially L-shaped seat having a first portion extending in a substantially parallel direction with respect to the relative movement direction of said upper and front quarters and a second portion extending perpendicular to said first portion.

29. An adjustment device according to claim 21, wherein said gliding abutment surface means comprises an essentially U-shaped seat having a first base portion extending in a substantially parallel direction with respect to the relative movement direction of said upper and front quarters and two second portions extending parallel to each other and perpendicular to said first base portion.

30. An adjustment device according to claim 3, wherein said seat has a third portion extending parallel to said second portion thereof to define, together with said first and second portions, a U shape.

31. An adjustment device according to claim 5, wherein one of said two component parts is a ski boot shell and the other of said two component parts is an upper quarter made monolithically with and upwardly to a front quarter, said front quarter being hinged to said ski boot shell, with said ski boot shell defining said gliding abutment surface means and said upper quarter comprising a seat defining said guide means.

32. An adjustment device according to claim 5, wherein one of said two component parts is a rear quarter and the other of said two component parts is an upper quarter made monolithically with and upwardly to a ski boot shell, said upper quarter being arranged internally to said rear quarter, said rear quarter defining guide means for said slider member, said guide means comprising a slot extending in a direction inclined to the longitudinal middle axis of said rear quarter, said upper quarter defining said gliding abutment surface means comprising a seat in the shape of an inverted V having a portion thereof which is substantially parallel to said slot.

33. An adjustment device according to claim 5, wherein said first body portion of said slider member comprises a tooth formed on a band and engaging with said gliding abutment surface means, said band element being connected to said second body portion of said slider member.

* * * * *